US008632639B2

(12) United States Patent
Böttcher et al.

(10) Patent No.: US 8,632,639 B2
(45) Date of Patent: Jan. 21, 2014

(54) MOBILE CLEANING DEVICE AND METHOD

(75) Inventors: Andreas Böttcher, Ratingen (DE); Andre Kluge, Dülmen (DE); Sabine Tüschen, Oberhausen (DE)

(73) Assignee: Siemens Aktiengesellschaft, Munich (DE)

( * ) Notice: Subject to any disclaimer, the term of this patent is extended or adjusted under 35 U.S.C. 154(b) by 413 days.

(21) Appl. No.: 12/743,052

(22) PCT Filed: Sep. 29, 2008

(86) PCT No.: PCT/EP2008/008263

§ 371 (c)(1), (2), (4) Date: May 14, 2010

(87) PCT Pub. No.: WO2009/065462

PCT Pub. Date: May 28, 2009

(65) Prior Publication Data

US 2010/0243000 A1 Sep. 30, 2010

(30) Foreign Application Priority Data

Nov. 23, 2007 (DE) ..... 10 2007 056 803

(51) Int. Cl.
*B08B 7/00* (2006.01)
*B08B 7/04* (2006.01)
*B08B 9/032* (2006.01)

(52) U.S. Cl.
USPC ..... 134/22.18; 134/10; 134/22.1; 134/22.11; 134/22.12; 134/34

(58) Field of Classification Search
USPC ..... 134/22.1, 22.18, 22.11, 22.12, 34, 10, 134/166 R, 167 C, 168 C, 166 C; 15/300.1, 15/320, 321, 345, 346, 404, 405, 406
See application file for complete search history.

(56) References Cited

U.S. PATENT DOCUMENTS

| | | | | |
|---|---|---|---|---|
| 2,948,092 | A | 8/1960 | Fuller | |
| 4,167,193 | A * | 9/1979 | Magnus et al. | 134/95.2 |
| 4,995,915 | A | 2/1991 | Sewell | |
| 5,401,324 | A * | 3/1995 | Huddas | 134/21 |
| 6,361,610 | B1 | 3/2002 | Janin | |
| 6,491,044 | B1 | 12/2002 | Bowsman | |
| 2003/0102012 | A1 | 6/2003 | Aven | |
| 2004/0163678 | A1 * | 8/2004 | Ogden et al. | 134/22.18 |
| 2005/0000550 | A1 | 1/2005 | Fick | |
| 2005/0199270 | A1 * | 9/2005 | Watt | 134/22.1 |
| 2009/0320891 | A1 * | 12/2009 | Liedtke | 134/169 R |

FOREIGN PATENT DOCUMENTS

| | | | |
|---|---|---|---|
| DE | 19832767 | A1 | 1/2000 |
| DE | 102005009274 | B3 | 7/2006 |
| EP | 1574675 | A2 | 9/2005 |
| WO | WO 9220468 | A1 | 11/1992 |
| WO | WO 03068380 | A1 | 8/2003 |
| WO | WO 2008019995 | A2 * | 2/2008 |
| WO | WO 2009065657 | A2 * | 5/2009 |

* cited by examiner

*Primary Examiner* — Alexander Markoff

(57) ABSTRACT

A mobile cleaning device for cleaning parts of a burner is provided. The mobile cleaning device includes a closable pressure vessel, wherein a nozzle end of the burner is located inside the pressure vessel. An end of the burner, which is used for supplying fuel and is arranged opposite from the nozzle end, is located outside the pressure vessel. Further, a method for cleaning parts of the burner is provided.

5 Claims, 3 Drawing Sheets

MOBILE CLEANING DEVICE AND METHOD

CROSS REFERENCE TO RELATED APPLICATIONS

This application is the US National Stage of International Application No. PCT/EP2008/008263 filed Sep. 29, 2008, and claims the benefit thereof. The International Application claims the benefits of German Application No. 10 2007 056 803.9 DE filed Nov. 23, 2007. All of the applications are incorporated by reference herein in their entirety.

FIELD OF INVENTION

The present invention relates to a mobile cleaning device for cleaning components of a burner. The invention also relates to a method for cleaning components of a burner.

BACKGROUND OF INVENTION

The burners of gas turbines comprise a plurality of tube-like fuel line systems which are embodied for different fuels. Each burner has a first end at which fuels can be supplied to the burner via different connecting ports. In the installed state the second end of the burner disposed opposite the first end of the burner leads into the combustion chamber of the gas turbine. The second end is usually provided with a plurality of nozzle systems from which the fuel or a fuel/air mixture can be injected into the combustion chamber. In order to securely mount the burner to a combustion chamber wall, a burner flange enclosing the burner is provided between the first and the second end and can be bolted to the combustion chamber wall.

During the operation of burners contamination can occur due to deposits, in particular in the region of the burner nozzles. Deposits can be caused for example as a result of the chemical reaction of sulfur compounds in the fuel with the base material of the burner components. As a result of said reaction, namely, iron sulfide deposits form in the interior of the burner. These sometimes lead to blocking of the holes through which the fuel is injected into the combustion chamber. This results in uneven combustion. As a consequence the burner can no longer deliver its full performance. In addition excessive deposits can damage burner components. In particular in the case of gas turbines a drop in power output due to contamination of the burner is detrimental, since this has a negative effect on the overall performance and the emission limit values of the gas turbine. The availability of the gas turbine is drastically compromised as a result.

Currently, when contaminants are detected in gas turbine burners, the burner nozzles are pierced by hand. Blow-out runs must then be carried out with the gas turbine during which any dirt residues will be blown out of the nozzles. Another method consists in installing new burners. This is associated with high costs, however. Since the problem occurs primarily on machines which are operated with preheat, there are likely to be a high number of machines requiring cleaning. Since different burners such as pilot or diffusion burners are present in an installation it is necessary to create a cleaning device which encompasses all burners. In addition it would be desirable to provide a cleaning device which can clean the burners in situ on the system without the necessity of dismantling the burner into its burner components.

U.S. Pat. No. 4,995,915 discloses a system for cleaning dirty gas firing nozzles in gas turbines, in which system a cleaning chemical is added to the gas while the gas turbine is in operation.

DE 10 2005 009 274 B3 relates to a cleaning method for combustor plants having at least one combustion chamber for post-combustion of combustion gases and in which at least one air jet is injected into the combustion chamber in order to improve the post-combustion by turbulences of the combustion gases. If necessary a swirl is imparted at times to the air jet of DE 10 2005 009 274 B3. Insofar as a swirl is already superimposed on the injected air jet for the purpose of improving the mixing process, the swirl for cleaning purposes is therefore generated in addition.

SUMMARY OF INVENTION

It is an object of the present invention to provide an improved device for cleaning components of a burner which allows easier cleaning without the need to disassemble the burner on the system. A further object is to disclose a method for cleaning components of a burner which can be performed in particular in situ on the system.

This object is achieved in relation to the device by the disclosure of a mobile cleaning device for cleaning components of a burner, wherein the burner has an original flow direction in the combustion operating mode, wherein the burner has a nozzle on the outlet side in the original flow direction, wherein a closable pressure vessel is included, and wherein the nozzle-side end of the burner is arranged inside the pressure vessel and the first end of the burner provided for supplying fuel and disposed opposite the nozzle-side end is provided outside of the pressure vessel.

The mobile cleaning device therefore essentially comprises a closable pressure vessel. The nozzle-side, outlet-side end of the burner is arranged inside the pressure vessel. The first end of the burner provided for supplying fuel and disposed opposite the outlet-side end is then provided outside the pressure vessel. Therefore, only the nozzle-side end of the burner is provided with a pressure vessel during the cleaning operation. Said pressure vessel is mounted as necessary, i.e. during the cleaning, and subsequently demounted after the cleaning has been completed. As a result of the use of a mobile device of this kind, soiled burners can be reached directly at the installation site, on the system or in the case of various cleaning devices. By means of the cleaning device according to the invention it is now no longer necessary to dismantle the burner into individual subassemblies. As a result much more frequent cleaning is possible, which contributes toward maintaining the emission limit values.

The pressure vessel wall is preferably formed at least in part by the burner flange.

In a preferred embodiment the pressure vessel is also securely mounted to the burner flange. Holes already present on the burner flange can be used for this. Fast and uncomplicated mounting is therefore possible. Preferably the mounting of the pressure vessel includes for this purpose a quick-clamping device by means of which the burner flanges are sealed.

In a preferred embodiment the mobile cleaning device includes an interchangeable cover. Pilot and diffusion burners, for example, can be cleaned by means of one and the same mobile unit via said interchangeable cover. The pilot or diffusion burner is in this case mounted in the mobile unit by way of the interchangeable cover. If the interchangeable covers are different in size, due, for example, to a different hole pattern, burners of different gas turbines can be serviced, with the result that only one cleaning base body is required.

The interchangeable cover is preferably comprised of high-strength aluminum and/or a high-strength aluminum alloy. This relatively lightweight material is characterized by a particular strength and rigidity. The lightness of the material is also advantageous in terms of the mobility of the cleaning device.

In a preferred embodiment the pressure vessel has a powder coating. This extends the useful life even when e.g. citric acid is used as a cleaning agent.

The pressure vessel is preferably securely mounted onto a movable base by means of a worm gear. By means of the movable base the device can be suitably positioned, e.g. when disassembling the burner.

A collecting vessel is also provided in the case of the mobile cleaning device. The collecting vessel serves to catch the deposits and also—when a washing fluid is used for the cleaning operation—said washing fluid.

The object is achieved in relation to the method by the disclosure of a method for cleaning components of a burner, wherein the burner has an original flow direction in the combustion operating mode, wherein the burner has a nozzle on the outlet side in the original flow direction, and wherein the burner is connected at the nozzle side to a mobile cleaning device, and wherein the component to be cleaned is blown out in the opposite direction to the direction of the fuel flow so that deposits are dislodged and blown out. In this case the blowing-out process is preferably performed using a washing fluid under increased pressure. Furthermore the blowing-out process can be performed using compressed air under increased pressure.

By means of the method it is therefore possible to force dislodged deposits through the burner and through its connecting ports from the front, on the "nozzle side", with washing fluid and/or using compressed air or a connected compressor.

If washing fluid is used to blow out contaminants, the pressure vessel can additionally have a vent hole and a connecting adapter for a pump. Other connecting ports, in particular inlets and outlets of the burner, should be closed in a pressure-tight manner. The burner or the components are in this case cleaned by purging with a solution under increased pressure. Toward that end washing fluid is pumped by means of a pump into the pressure vessel from a reservoir for washing fluid until said pressure vessel is sufficiently full. When the pressure vessel is being filled, the vent hole or holes is or are open. Once the pressure vessel has been filled to a sufficient level, purging is performed at increased pressure. For that purpose the vent hole is closed. The required purge pressure is built up by the pump, which is connected to a washing fluid reservoir. As a result of said pressure the solution flows through the burner into the collecting vessel, dislodges deposits thereby, and entrains the dislodged deposit particles.

If compressed air is used for the purging, the compressed air is pumped through the inlet openings into the pressure vessel until the latter has been filled to a sufficient level. Once the pressure vessel has been filled to a sufficient level, the compressed air flows at high pressure through the component that requires cleaning and thereby dislodges deposits.

A particularly efficient cleaning action is produced by the combination of the two possibilities. In this case the burner is cleaned first, that is to say in particular the individual fuel nozzles and the internal fuel lines of the burner that are connected thereto, by means of purging of the burner fuel lines with a washing fluid under increased pressure, wherein the through-flow also takes place in the reverse direction—referred to the fuel flow direction. By this means the deposits in the interior of the burner are dislodged and washed away (blowing-out by means of washing fluid). The washing fluid can also pulsate, since this can remove deposits in the dead spaces of the flow. A further increase in the cleaning effect is achieved by a reversal of the flow.

Following this, the burner is dried and cleaned particularly thoroughly in that compressed air is injected under high pressure (e.g. >=6 bar) into the pressure vessel and flows away through the interior of the burner, i.e. through its fuel lines. In this case the air also flows in the opposite direction—referred to the fuel flowing otherwise—with the result that the particles blown out with the air exit from the burner through the first end. The air flow can also pulsate in order to prevent the dislodged particles from becoming deposited in a bend in a line (blowing-out by means of compressed air).

The compressed air or/and the washing fluid preferably has/have particles. These have an abrasive effect. By this means it is additionally possible to dislodge or "knock off" the deposits mechanically from the component walls.

BRIEF DESCRIPTION OF THE DRAWINGS

Further features, advantages and details of the invention will now be described in more detail with reference to the simplified and not-to-scale representations of the drawings, in which.

Like parts are labeled by the same reference signs in all the figures.

DETAILED DESCRIPTION OF INVENTION

Figure 1:
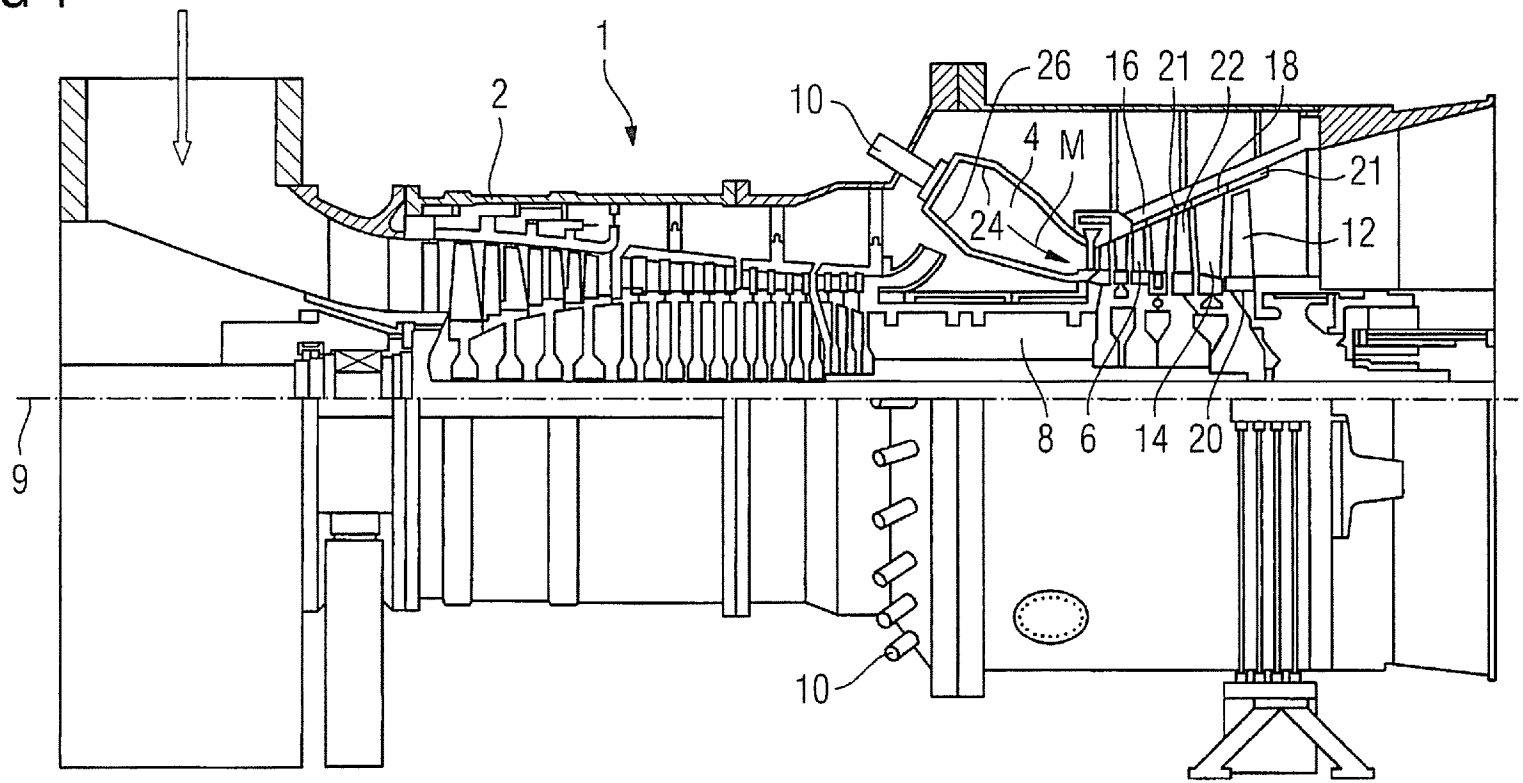
FIG. 1 shows a schematic view of a gas turbine.

The gas turbine 1 according to FIG. 1 has a compressor 2 for combustion air, a combustion chamber 4 as well as a turbine 6 for driving the compressor 2 and a generator or working machine (not shown in more detail) as well as an annular space 24 for transferring the hot gas M from the combustion chamber 4 to the turbine 6. Supplied air L is compressed in the compressor 4. To that end the turbine 6 and the compressor 2 are arranged on a common turbine shaft 8, also referred to as a turbine rotor, to which the generator or working machine is also connected and which is rotatably mounted about its central axis. The turbine 6 has a number of rotatable rotor blades 12 connected to the turbine shaft 8. The rotor blades 12 are disposed on the turbine shaft 8 in an annular arrangement and thus form a number of rotor blade rows. The turbine 6 also comprises a number of stationary vanes 14. The rotor blades 12 serve to drive the turbine shaft 8 by means of pulse transfer from the hot medium, the working medium, for example of the hot gas M, flowing through the turbine 6. The vanes 14, on the other hand, serve to guide the flow of the working medium, of the hot gas M, for example. Each vane 14 also has a platform 18, also referred to as a blade root, which is arranged for fixing the respective vane 14 on the inner casing of the turbine 6 as a wall element. Each rotor blade 12 is secured in an analogous manner via a platform, also referred to as a blade root 20, to the turbine shaft 8. A guide ring 21 is arranged in each case on the inner casing 16 of the turbine 6 between platforms 18 of the vane 14 of two adjacent vane rows, which platforms are arranged spaced apart from each other. In this arrangement the guide rings 21 disposed between adjacent vane rows serve in particular as cover elements which protect the inner wall 16 or other housings against a thermal overload due to the hot working medium M flowing through the turbine 6. In the exemplary embodiment the combustion chamber 4 is embodied as what is known as an annular combustion chamber in which a plurality of burners 10 arranged around the turbine shaft 8 in the circumferential direction open out into a common combustion chamber space. For that purpose the combustion chamber 4 is embodied in its entirety as an annular structure that is positioned around the turbine shaft 8.

Iron sulfide deposits, that is to say deposits in the interior of the burner, form due to the chemical reaction of sulfur compounds (H2S) in the fuel with the base material of the burner components. Said deposits flake off and sometimes lead to a blockage of the holes, in particular the smaller holes, through which the fuel is injected into the combustion chamber. This results in uneven combustion, consequently considerably worsening the emission values of the affected burners 10. The availability of the machine is adversely affected to a significant degree.

Figure 2:
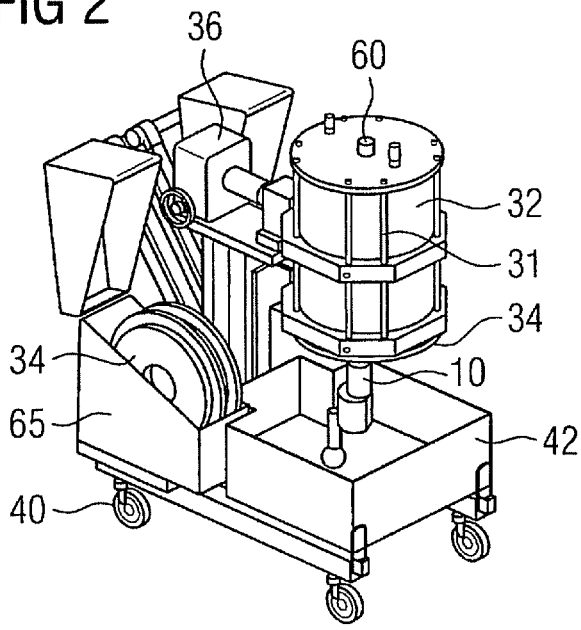
FIG. 2 shows the inventive device for cleaning components of a burner.

FIG. 2 shows a mobile cleaning device for cleaning components of a burner 10. Said device essentially comprises a closable pressure vessel 32. In this case the pressure vessel 32 can be embodied as a housing or as a type of bell. In this case it preferably consists of a seamless steel tube. In order to improve corrosion resistance the housing can be coated, e.g. powder-coated. The pressure vessel 32 can be manufactured from a steel or steel alloy or a high-strength aluminum or aluminum alloy. High-strength ties or tie rods 31 are mounted on the pressure vessel 32.

Figure 4:
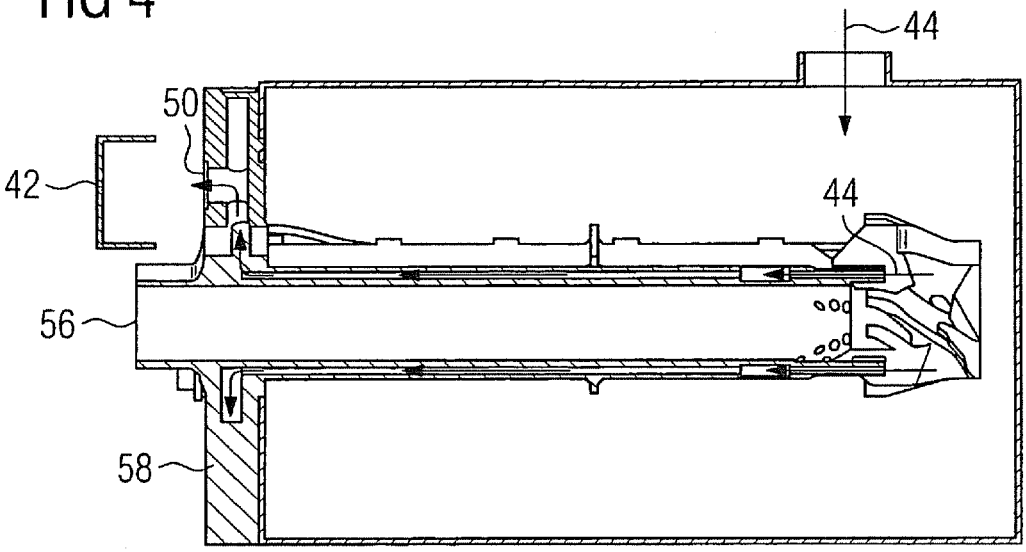

In this case the pressure vessel 32 is securely mounted to the burner flange 58 (FIG. 4). Holes that are already present can be used in this case. This ensures a particularly fast and simple fixing.

Figure 5:
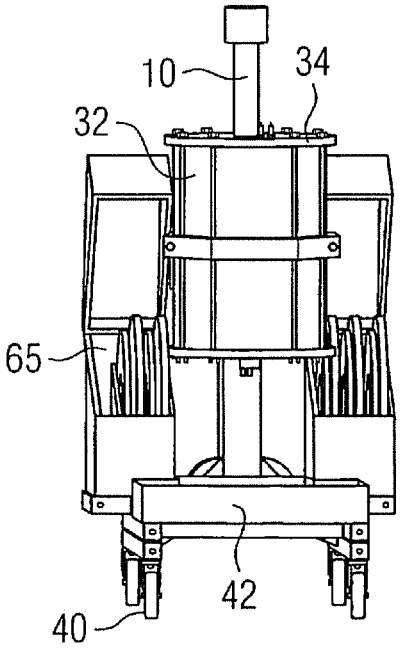

A part of a pressure vessel wall can be formed in this case by the burner flange 58 (FIG. 4, FIG. 5), such that the nozzle-side, outlet-side end of the burner 10 is arranged inside the pressure vessel 32. The first end of the burner 10 provided for supplying fuel and disposed opposite the outlet-side end is then provided outside of the pressure vessel 32. A collecting vessel 42 (FIG. 1) is connected to said burner end. In this case it can be directly connected to a movable base 40. The collecting vessel 42 can be connected to the fuel lines (FIG. 2). The burner 10 is fixed via its burner flange 58 which can be connected to the mobile cleaning device in a pressure-tight manner by means of a quick-clamping device 46. The pressure vessel 32 also includes a worm gear 36 which has a self-locking closure. This is connected to the movable base 40 which contributes significantly to the mobility of the cleaning device and considerably simplifies a positioning of the cleaning device. As a result of the use of a mobile device contaminated burners 10 can be reached directly at the installation site, on the system or in the case of various cleaning devices. FIG. 1 also shows the mobile cleaning device with burner 10 during the blowing-out process.

The mobile cleaning device also has an interchangeable cover 34. Pilot and diffusion burners can be cleaned by one and the same mobile cleaning device by way of said interchangeable cover 34. In this case the interchangeable cover 34 can be implemented in different sizes, with a different hole pattern, for example. A receptacle 65 which accommodates the different interchangeable covers 34 can thus be arranged on said movable base 40.

The pilot or diffusion burner of a burner 10 is in this case mounted in the mobile unit with the aid of the interchangeable cover 34. The burner flange 58 is sealed off by means of the quick-clamping device.

This enables burners 10 of different gas turbines to be serviced, with the result that only a cleaning base body is required.

Figure 3:
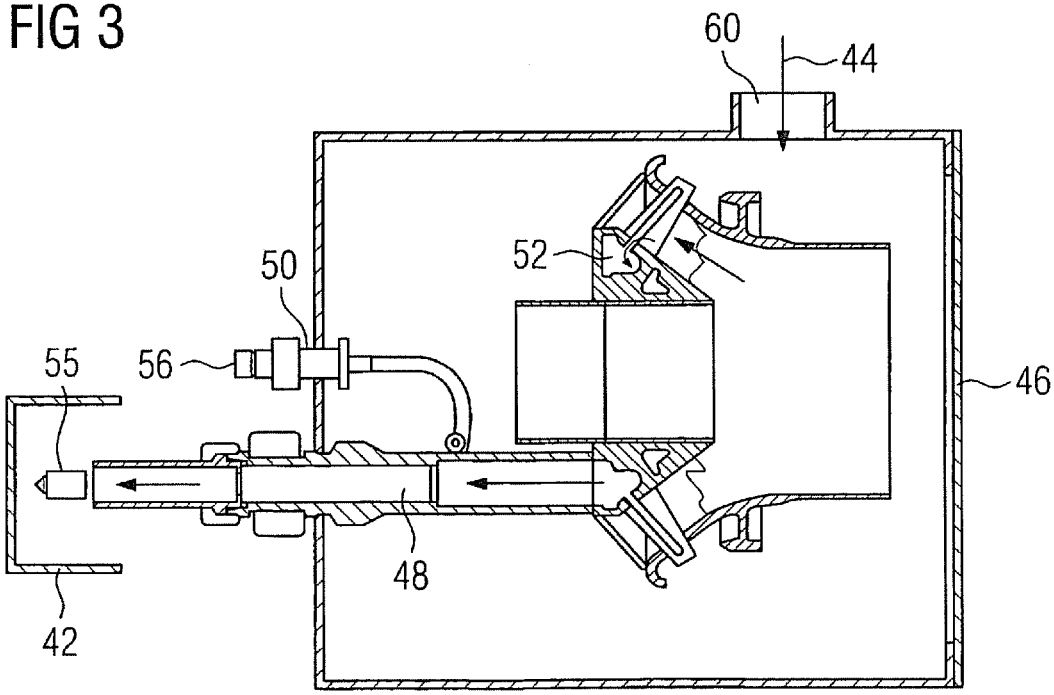
FIG. 3 schematically shows the cleaning of the diagonal grid and the premix line with the aid of the mobile cleaning device, FIG. 4 schematically shows the cleaning of an oil feed with the aid of the mobile cleaning device, FIG. 5 schematically shows the burner mounting.

FIG. 3 schematically shows the cleaning of the diagonal grid 52 and the premix line 48 with the aid of the mobile cleaning device. The burner 10 is introduced on the nozzle side into a pressure vessel 32, the pressure vessel being closed by means of a cover 46. In this case the pressure vessel includes an inlet opening 60 which is preferably mounted at the downstream end of the pressure vessel 32. Compressed air 44 is injected through said inlet opening 60 with the aid of a compressed air device (not shown). The compressed air 44 flows into the pressure vessel 32 under high pressure (>=6 bar) against the flow direction of the burner fuel into the burner 10, through the diagonal grid 52 and then through the premix gas line 48. In order to achieve the highest possible pressure for dislodging the deposits, other inlets and outlets, such as in this case the oil line 50, for example, are provided with plugs 56. The contaminants dislodged in the cleaning bath are thus conveyed away by means of compressed air or the connected compressor through the diagonal grid, which has openings with a small diameter on the vanes and blades for example, toward the front, "nozzle side or upstream", through the burner 10 (larger diameter), i.e. through its connection ports. The premix gas line 48 of the burner 10 is connected to a non-pressurized collecting vessel 42. In this case the contaminant particles can also be blown out by way of an attenuator 55.

Thus, the air flows in the reverse direction—referred to the fuel otherwise flowing—so that the particles blown out by means of the air 44 emerge from the burner 10 through the first end.

Consequently the dirty components of the burner 10 are blown out effectively "backwards". In this case the air flow 44 can be applied in a pulsating manner in order to prevent the dislodged deposit particles of the deposits from accumulating in a bend in the line.

FIG. 4 shows the cleaning of the oil passage 50 by means of compressed air 44. In this case the premix gas line 48 is closed with a plug 56. Outlets on the burner flange 58 must also be closed in a pressure-tight manner.

FIG. 5 shows once again in a schematic representation the fixing of the pressure vessel 32 to the flange 58 from above. The easy assembly is illustrated in this case. Conversely, the blow-out direction is downward (FIG. 1). Following the assembly the burner 10 can be rotated in the blow-out direction with the aid of the worm gear 36, for example.

Other components/passages on the burner 10 can also be cleaned in this way. All that is required for this is to close the inlets and outlets alternately with plugs 56 or similar closures.

In this case the mobile cleaning device can be operated with compressed air 44 or with a washing fluid. In the latter case the component is cleaned by means of purging with a solution under increased pressure. Toward that end the burner 10 is screwed with its flange 58 to a pressure vessel 32. The seal is accomplished by means of an O-ring (not shown) by means of which the burner 10 is also sealed in the gas turbine.

During purging with a washing fluid the pressure vessel 32 can have—instead of or in addition to an inlet opening 60—the two following access ports: firstly a connecting adapter (not shown) for a pump, secondly a vent hole (not shown).

In this case the vent hole is opened when the pressure vessel 32 is filled with washing fluid and closed during the purging process. The required pressure is built up in the washing fluid by means of the pump such that the solution flows through the burner 10 against the flow direction of the fuel and consequently sweeps deposits along with it. In this case the pump is preferably also connected to a container for cleaning fluid. Suitable washing fluids include for example organic acids, which can be reused after a cleaning operation.

Due to the pressure the solution thus flows through the burner 10 into the collecting vessel 42, entraining dislodged particles in the process. An intensification of the cleaning effect can be obtained by means of a pulsating flow. This can be achieved for example via a connected pulse generator. As a result of the pulsating mode of operation contaminants in dead spaces of the flow are also reached and removed. A further increase in the cleaning effect can also be achieved by a reversal of the flow.

Following the purging with the washing fluid the solution is siphoned off and the connecting adapter closed for the pump for the purpose of drying the component. Compressed air is injected into the tank through the vent hole, then flows through the component, e.g. the diagonal grid, dries the latter and removes any remaining contaminants.

The washing fluid and the compressed air can also have particles which have an abrasive effect and thus remove deposits from the walls mechanically. If a washing fluid or compressed air has been used with particles, it is of advantage, upon completion of the cleaning, to flush the burner 10 with a washing fluid without particles or, as the case may be, with compressed air without particles.

The "backward blow-out" of the burner 10 with washing fluid and compressed air can therefore also be performed together as a method. This provides an extremely efficient cleaning method comprising two steps. First, in the first step, the burner 10, in particular of the diagonal grid 52 and the individual fuel nozzles and, in fluidic communication therewith, the internal fuel lines of the burner 10, are cleaned by means of purging of the burner fuel lines with a washing fluid under increased pressure, the solution flowing through in the reverse direction—referred to the direction of fuel flow. By this means the deposits in the interior of the burner 10 are dislodged and washed away.

Next, in the second step, the burner 10 is dried and cleaned particularly thoroughly in that compressed air 44 is injected into the pressure vessel 32 under high pressure (>=6 bar) and flows away through the interior of the burner 10, i.e. through its fuel lines. In the process the air flows in the reverse direction—referred to the fuel flowing otherwise—with the result that the particles blown out with the air exit out of the burner 10 backwards, as it were. The air flow 44 can also pulsate in order to prevent the dislodged particles from being deposited in a bend in the line.

Both steps can be performed in a single cleaning device or also in two different cleaning devices.

The backward blow-out with washing fluid or compressed air can, of course, also be performed separately.

A mobile cleaning device for cleaning components of a burner is provided by means of the invention. Also disclosed is an extremely efficient method for cleaning components of a burner which can comprise two steps. The first step serves mainly to dislodge the particles from the base material of the burner and to wash them away and the second step serves mainly for drying and to convey away the remaining particles.

The mobility of the cleaning device results in rapid availability of the device at different locations. Thanks to the interchangeable covers different burners of the different machine types can be cleaned by means of one base body. Different burner types, such as pilot and diffusion burners, can also be cleaned. In particular it is possible to clean a pilot burner, in particular a premixed pilot burner, which has even smaller mixing nozzles than in the case of the already blocked diffusion burner, can be blown out using the mobile unit. This is particularly advantageous since there is currently no satisfactory solution for pilot burners (diffusive and premixed) for removing deposits efficiently from the component. Thanks to the cleaning device and the method according to the invention it is now possible to dispense with the dismantling of the burner into individual subassemblies. Furthermore new components or manual cleaning are no longer necessary. Both, namely, would result in huge costs, not only due to the cost of the components per se, but also due to the long downtimes. It is also advantageous that the fast and simple performance of the method by means of the device also enables the deposits to be removed more frequently, as a result of which it becomes much easier to comply with the emission limit values. Also favorable is the efficient cleaning of component sections which are not easy to clean or are impossible to clean manually (undercuts, cavities). However, the device presented here as well as the method can be used not only on burners with premix gas channels, but on any type of burner, including, for example, burners for industrial gas turbines. Thus, faster and superior cleaning directly on the system is possible by means of the device and the method. If the burner is cleaned in an acid bath, in particular in a citric acid bath, blowing out during the individual steps is possible.

The invention claimed is:

1. A method for cleaning different burners, the method comprising:

providing a mobile cleaning device with a closable pressure vessel, a plurality of different interchangeable covers and a collecting vessel;

placing a first burner into the closable pressure vessel with a first interchangeable cover such that a nozzle side of the first burner is located inside of the closable pressure vessel while an end of the first burner for supplying fuel is located outside of the closable pressure vessel;

filling the closable pressure vessel with air;

closing and pressurizing the closable pressure vessel;

blowing out a first component to be cleaned of the first burner with pressurized air, wherein deposits of the first component are dislodged and blown out into the collecting vessel;

dismounting the first burner, wherein, if a second burner is to be cleaned, the following performed:

placing a second burner into the closable pressure vessel with a second interchangeable cover such that a nozzle side of the second burner is located inside of the closable pressure vessel while an end of the second burner for supplying fuel is located outside of the closable pressure vessel;

filling the closable pressure vessel with air;

closing and pressurizing the closable pressure vessel; and blowing out a second component to be cleaned of the second burner with pressurized air, wherein deposits of the second component are dislodged and blown out into the collecting vessel.

2. The method as claimed in claim 1, wherein, in addition to the blowing out with pressurized air, the blowing out is performed by a washing fluid, wherein the washing fluid has particles.

3. The method as claimed in claim 1, wherein the pressurized air has particles.

4. The method as claimed in claim 1, wherein the plurality of interchangeable covers comprises high-strength aluminum or high-strength aluminum alloy.

5. The method as claimed in claim 1, wherein the closable pressure vessel comprises a powder coating, and wherein the closable pressure vessel is securely mounted onto a movable base of the mobile cleaning device by a worm gear.

* * * * *